United States Patent [19]

Chow

[11] 4,137,939

[45] Feb. 6, 1979

[54] HOSE REEL CART

[75] Inventor: Ho Chow, River Edge, N.J.

[73] Assignee: Melnor Industries, Moonachie, N.J.

[21] Appl. No.: 840,971

[22] Filed: Oct. 11, 1977

[51] Int. Cl.[2] ..... B65H 75/34; B65H 75/40

[52] U.S. Cl. ..... 137/355.27; 137/355.16; 242/86.2

[58] Field of Search ..... 137/355.16, 355.27, 137/355.26, 355.12; 242/86, 86.2, 86.3; 239/198, 199

[56] References Cited

U.S. PATENT DOCUMENTS

| | | | |
|---|---|---|---|
| 432,467 | 7/1890 | Wirt | 242/86.2 |
| 549,202 | 11/1895 | London | 242/86.2 |
| 1,048,863 | 12/1912 | Notman | 242/86.4 |
| 2,488,425 | 11/1949 | Morrone | 242/86.2 |
| 2,501,333 | 3/1950 | House | 137/355.12 |
| 2,512,756 | 6/1950 | Wasserman | 242/86.2 |
| 2,590,963 | 1/1952 | Hannay | 242/86.2 |
| 2,635,008 | 4/1953 | Nelson | 137/355.26 |
| 2,642,312 | 6/1953 | Shine | 137/355.2 |
| 3,587,626 | 6/1971 | Crowley | 137/355.27 X |

*Primary Examiner*—Martin P. Schwadron
*Assistant Examiner*—A. Michael Chambers
*Attorney, Agent, or Firm*—James & Franklin

[57] ABSTRACT

A portable hose reel cart comprises a cart frame, a rotatable reel, and wheels secured to said frame. The frame comprises a handle portion, a support portion, and a pair of angled intermediate portions disposed on opposite sides of the frame and connecting the handle and support portions. The reel is secured to the frame and adapted for rotation about an axis intersecting the intermediate portions, and the wheels are adapted to form with the support a stable base for the frame. The resultant cart is movable to a first stable and generally upright reeling position wherein the frame is supported by the wheels and support portion, a second stable and generally horizontal unreeling position wherein the frame is supported by both the handle and support portions with the reel being free for rotation, and a third unstable transporting position wherein the frame is supported essentially by only the wheels of the cart.

10 Claims, 7 Drawing Figures

HOSE REEL CART

BACKGROUND OF THE INVENTION

The present invention relates to portable hose reel carts, and more particularly to portable hose reel carts capable of assuming a variety of different positions corresponding to given uses of the cart.

Ideally a hose reel cart should be capable of assuming three different positions corresponding to the functions to be performed by the cart in each position. The first position is a stable and generally upright one in which the reel is well spaced above the ground to facilitate manipulation of a crank or other means for reeling the hose upon the reel. The wheels of the cart may be in contact with the ground, as the user is in the immediate vicinity of the cart and capable of holding the handle thereof to prevent rolling of the cart upon the wheels, but the reel should be placed as far above the ground as possible to minimize the degree to which the person doing the reeling must bend. The second position is a stable and generally horizontal one in which both the reel and the wheels of the cart are spaced at least slightly above the ground so that the cart is unlikely to roll while the user unreels the hose by walking away from the cart with the nozzle portion of the hose. As the user will be positioning himself away from the cart during the process of unreeling the hose, it is necessary that the cart not be easily movable along the ground in this position so that the cart does not tend to follow the user. The third position is an unstable one used for transporting the reel, with the cart frame being supported essentially only by the wheels of the cart. The function of the user in this position is to provide the locomotion force for transporting the cart and the balancing force for maintaining it in the unstable transporting position.

In addition to being able to assume the three positions described above, the cart should have the reel mounted on the cart frame with the axis of rotation of the reel extending transverse to the cart frame axis (i.e., the reel being mounted across the cart frame) to provide a desirable weight distribution for the cart and enable the hose to be supplied with fluid via a fluid inlet having one end projecting from a side of the reel for connection to a fluid supply and the other end projecting from the circumference thereof for connection to the hose. It is also important in such a cart that any sealing means used to insure a water-tight fluid connection between the fluid inlet and fluid supply be easily replaceable so that a failure of the sealing means does not require replacement of the entire hose reel cart.

To further facilitate the reeling function, it is also desirable that the handle of the crank mechanism used to turn the reel should be rotatable relative to the remainder of the crank mechanism so that the user's wrist can adapt the most natural position for it at any given instant during a complete revolution of the crank.

Accordingly, it is an object of the present invention to provide a portable hose reel cart capable of assuming three distinct positions; a stable and generally upright reeling position, a stable and generally horizontal unreeling position, and a third unstable transporting position.

It is another object to provide such a cart in which the reel axis is transverse to the cart frame axis.

It is also an object to provide such a cart in which any sealing means used to provide a fluid-tight connection between the fluid supply and fluid inlet is easily replaceable.

It is a further object to provide such a cart in which the handle of the crank mechanism for the reel is capable of rotating relative to the crank mechanism

SUMMARY OF THE INVENTION

The above and related objects of the present invention are obtained in a portable hose reel cart comprising a cart frame, a rotatable reel, and wheels. The cart frame comprises a handle portion, a support portion, and a pair of angled intermediate portions. Each of the intermediate portions is disposed on an opposite side of the frame and connects the handle portion and the support portion. The reel is secured to the frame and adapted for rotation about an axis intersecting the intermediate portions. The angled intermediate portions and the length of the handle, intermediate and support portions are such as to enable a stable rotatable disposition of the reel above a planar support when the frame is supported on the planar support by the support and handle portions. The wheels are rotatably secured to the frame and adapted to form with the support portion a stable base for the frame.

The cart is movable to a first stable and generally upright reeling position wherein the frame is supported by the wheels and the support portion, a second stable and generally horizontal unreeling position wherein the frame is supported by both the handle and support portions with the reel being free for rotation, and a third unstable transporting position wherein the frame is supported essentially by only the wheels of the cart.

In a preferred embodiment, the frame comprises a continuous member with the handle and support portions both being generally U-shaped, and each intermediate portion connecting a respective associated end of the handle portion to a respective associated end of the support portion. Preferably the reel is disposed between the intermediate portions, and the wheels are rotatably secured to the support portion.

The cart may additionally include crank means operatively connected to the reel for rotating the reel relative to the frame. The cart may also include a fluid inlet mounted on one of the intermediate portions and a hose connector having one end exposed on the exterior of the reel and the other end extending into the interior of the reel and in fluid communication with the fluid inlet.

In one aspect of the present invention, the portable hose reel cart comprises a cart frame and a reel having one side thereof rotatably mounted on the frame and the other side defining a hollow hub extending axially therefrom. A hub support is disposed about the reel hub, the reel hub being rotatable relative to the hub support and precluded from axially retreat therefrom. The cart further includes an inlet assembly adapted for connection to a fluid source and configured and dimensioned to receive the reel hub therein, replaceable sealing means disposed intermediate portions of the inlet assembly and the reel hub to provide a fluid-tight connection therebetween and securing means movable between first and second positions. In the first position the securing means secures together the inlet assembly and the hub support with the sealing means disposed intermediate portions of the inlet assembly and the reel hub. In the second position the securing means enables separation of the inlet assembly and the hub support, whereby the aforesaid portions of the inlet assembly and reel hub are separable to enable replacement of the sealing means.

In another aspect of the present invention, the portable hose reel cart comprises a cart frame, a reel rotatably mounted on the frame, and crank means secured to the reel for rotating the reel relative to the frame and including a lug extending along an axis generally parallel to the axis of the reel. Handle means are disposed about the lug, the handle means being rotatable about the lug axis and precluded from axially retreat from the lug.

DETAILED DESCRIPTION OF THE PREFERRED EMBODIMENTS

Figure 1:
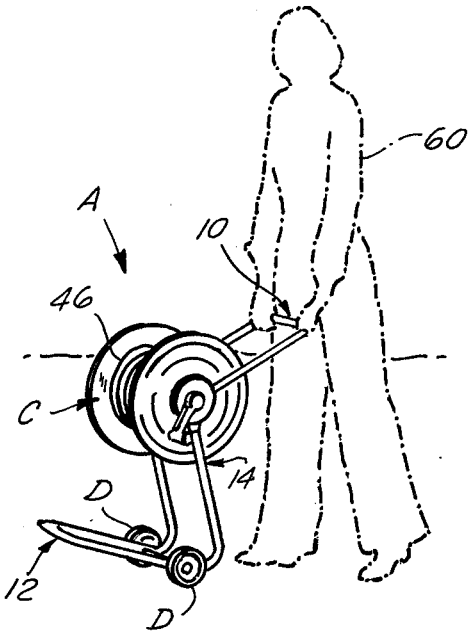
FIG. 1 is an isometric view of a portable hose reel cart of the present invention in its transporting position, the user thereof being indicated in phantom line.

Referring now to the drawing, and in particular to FIGS. 1–4 thereof, therein illustrated is a portable hose reel cart, generally designated A, comprising a cart frame, generally designated B, a rotatable reel, generally designated C and secured to the frame B, and a pair of wheels, generally designated D and rotatably secured to the frame B.

More particularly, the cart frame B is comprised of a generally U-shaped handle portion, generally designated 10, a generally U-shaped support portion, generally designated 12, and a pair of angled intermediate portions, generally designated 14. Each of the intermediate portions 14 is disposed on an opposite side of the frame B and connects one leg 16 of the handle portion 10 to one leg 18 of the support portion 12. Each intermediate portion 14 in turn comprises a first leg 20 secured to a handle portion leg 16 by screws 22 and a second leg 24 secured to a support portion leg 18 by screws 26. The intermediate portion legs 20, 24 are angled with respect to each other to form a vertex, the axis of rotation of the reel C transversing and intersecting the vertices of the intermediate portions 14. If desired, the junction of legs 20, 24 may be smoothly curved.

Figure 5:
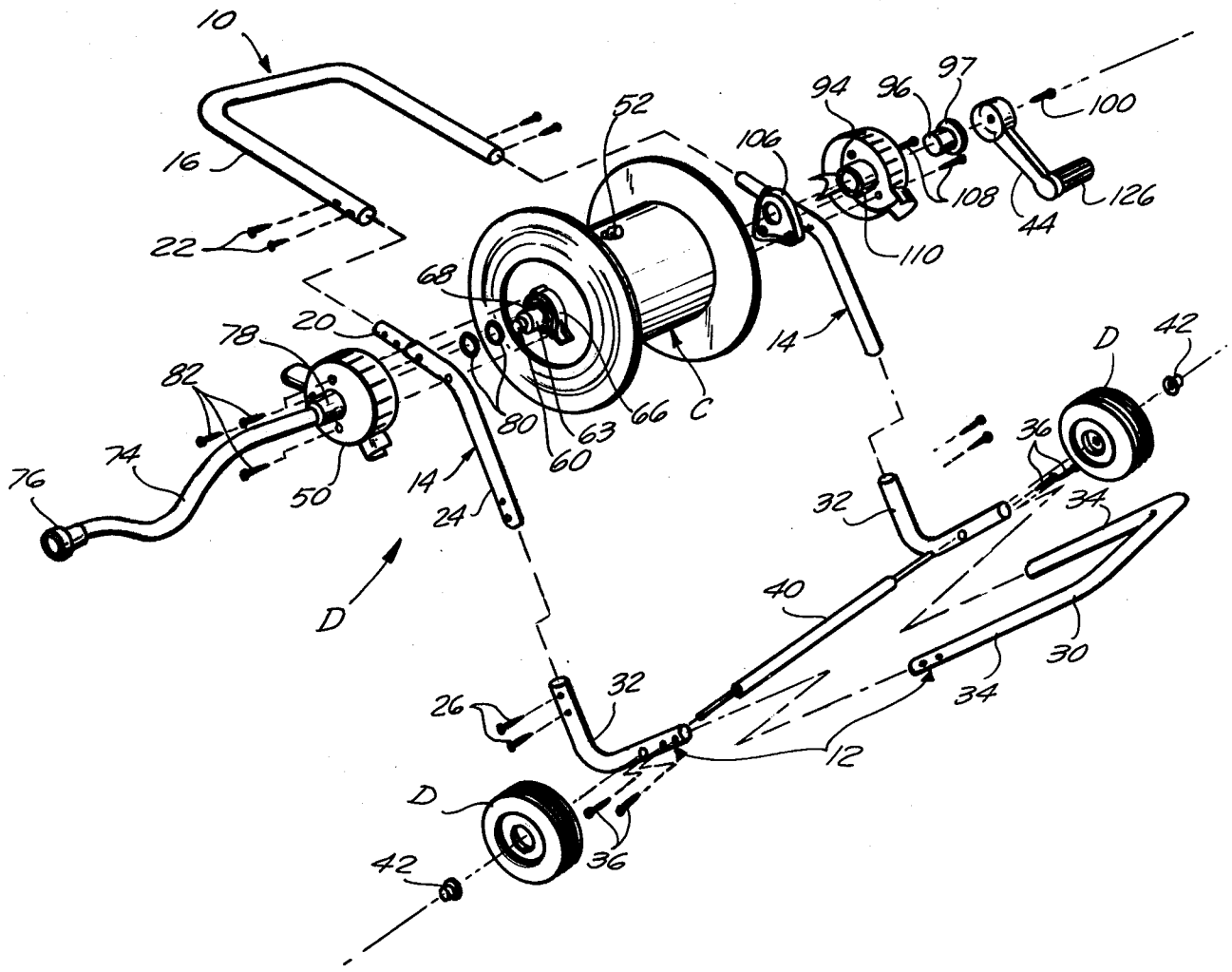
FIG. 5 is a explosed isometric view, to a greatly enlarged scale, of the cart.

In contrast to the legs 16 of the handle portion 10, which are preferably straight, the legs 18 of the support portion 12 are preferably curved or angled at about 80° as illustrated. Indeed, as illustrated in FIG. 5, the support portion 12 may be composed of a single U-shape member 30 and a pair of curved or angled leg sections 32 secured to the legs 34 of the U-shape member 30 by screws 36. In such a construction, the straight legs 34 and curved or angled legs 32 together comprise the legs 18 of the support portion 12. The wheels D are secured to the curved or angled legs 32 of the support portion 12 by means of an axle 40, the ends of the axle 40 passing through the legs 32 and wheels D. Pushnuts 42 affixed to the ends of the axle 40 preclude separation of the wheels D from the axle 40, and hence from the frame B. An important feature of the present invention contributing to the stability of the cart in its unreeling position is the disposition of the axis of rotation of the wheels D (i.e., the axle 40) not at the vertex of the legs 32, but rather forwardly thereof, that is, closer to the U-shape portion 30.

Optional features of the cart A to be discussed hereinafter in further detail include crank means 44 operatively connected to the reel C for rotating the reel C relative to the frame B and means for connecting a hose 46 (see FIGS. 1–3) to a fluid source (not shown), the connecting means including a fluid inlet 50 mounted on one of the intermediate portions 14 and adapted for connection to the fluid source and a hose connector having one end 52 exposed on the exterior of the reel C for making a fluid tight connection with the hose 46 and the other end extending into the interior of the reel C and in fluid communication with the fluid inlet 50 (and hence the fluid source).

It will be appreciated from the features of the cart described hereinabove that the cart A is movable to the three positions indicated in FIGS. 1–3. As illustrated in FIG. 1, with the assistance of the user 60 (indicated in phantom line), the cart A is capable of assuming an unstable transporting position wherein the frame B is supported essential only by the cart wheels D, the user 60, however, being required to maintain the cart A in the transporting position by his positioning of the handle portion 10 and to provide any locomotive force necessary to transport the cart A. Ideally the reel axis is maintained directly over the wheel axis in the transporting position, to minimize development of an undesirable torque effect as the cart is moved to and from given locations. To dispose and maintain the cart in the transporting position, the user 60 need only apply sufficient downward force to the handle portion 10 to raise the support portion 12 off the ground so that the cart A is free for movement upon its wheels D.

Figure 2:
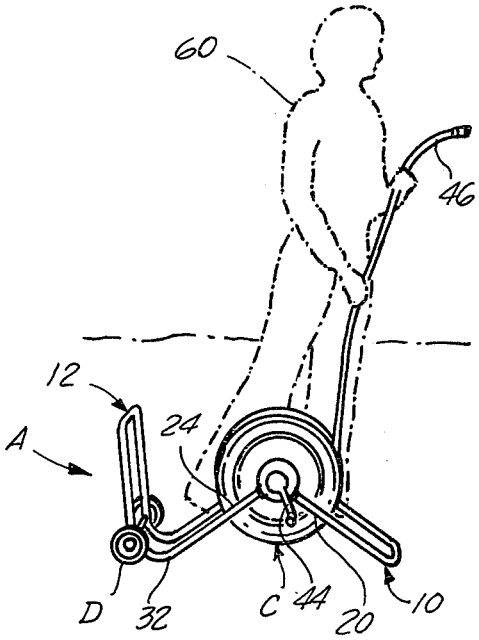
FIG. 2 is an isometric view of the cart in its unreeling position.

Illustrated in FIG. 2 is the stable and generally horizontal unreeling position of the cart A. In this position the frame B is supported by both the handle and support portions 10 and 12 with the reel C being spaced above the ground and free for rotation. More particularly, the frame B is supported at one end by the base of the handle portion 10 and at the other end by the vertex of legs 32 of the support portion 12. It will be recognized that the angle formed by the legs 20, 24 of the intermediate portions 14 and the length of the handle, intermediate and support portions 10, 14 and 12 are selected to enable a stable rotatable disposition of the reel C above the ground (or other planar support) when the frame B is supported on the ground by the support and handle portions 10, 12. The wheels D are preferably spaced sufficiently apart from the vertices of legs 32 so that they are suspended above the ground, thereby to enable the frictional engagement between the handle and support portions 10, 12, on the one hand, and the ground, on the other hand, to preclude travel of the frame B in this position during the unreeling process. The user 60 has only to grasp the free end of the hose 46 and walk away from the cart A to unreel the hose 46 from the reel C and lay it in a desired pattern on the ground. As the user need not turn the crank means 44 during the unreeling process, the positioning of the reel C close to the ground does not necessitate his maintaining an inconvenient bent position during the unreeling process.

Figure 3:
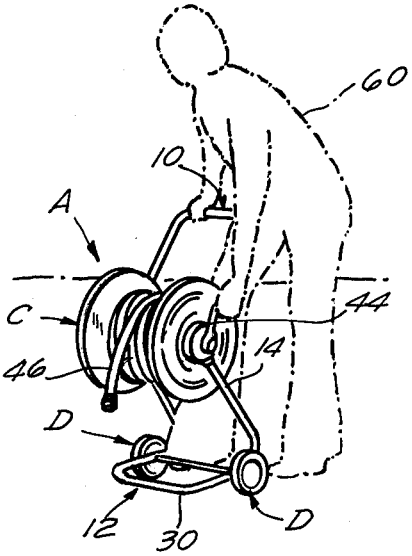
FIG. 3 is an isometric view of the cart in its reeling position.
Figure 4:
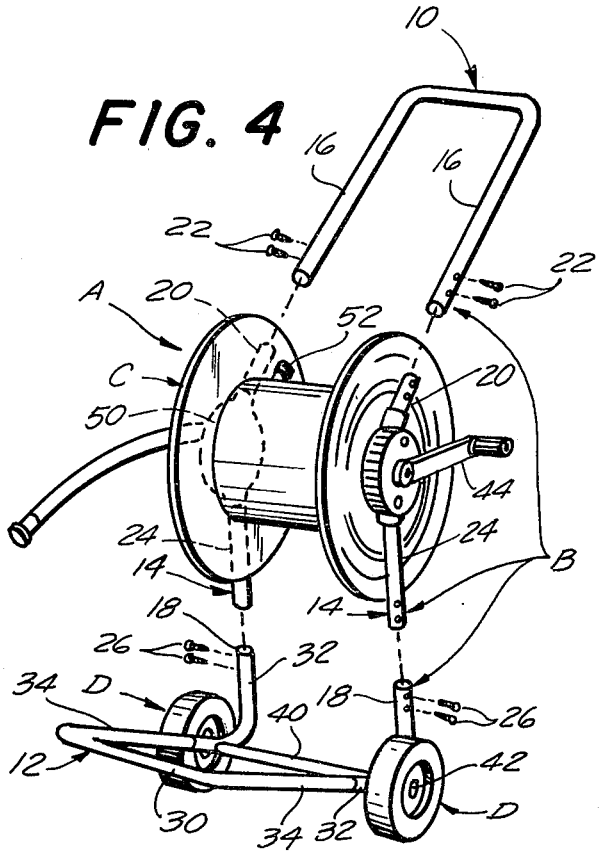
FIG. 4 is a partially exploded isometric view, to a slightly enlarged scale, of the cart.

Illustrated in FIG. 3 is the stable and generally upright reeling position of the cart A. In this position the frame B is supported by the wheels D and the support portion 12, and more particularly the base of the U-shape portion 30. The wheels D and support portion 12 together form a stable base for the frame B, with the reel axis being parallel to a second axis vertically displaced therefrom and passing through the legs of the support portion 12 intermediate the wheels 10 and the base of the U-shaped portion 30. In other words, when the cart is in the reeling position, the curved portions 32 insure that the reel axis is disposed sufficiently forwardly of the wheel axis to prevent backward tipping of the cart and sufficiently rearwardly of the base of the U-shaped portion 30 to prevent its forward tipping. Thus the presence of the user 60 is not required to maintain the cart in its stable reeling position. As the cart is supported at least partially in this position by means of the wheels D, however, there is a tendency for the cart to overcome the frictional effect between the ground and the base of U-shaped portion 30 and travel during the reeling process; accordingly, the user is advised to maintain a grasp on the handle portion 10 during the reeling process to preclude such travel, this being in any case a normal stance for the user 60 to assume as he is bent over the cart to turn the crank means 44. The length of intermediate portion legs 24 and support portion legs 32 is preferably selected to elevate the reel C well above the ground, thereby to minimize the amount of bending required on the part of the user 60 to rotate crank means 44.

It will also be readily appreciated that the hose 46 may also be reeled upon the reel C by rotation of crank means 44 while the cart is in the unreeling position illustrated in FIG. 2, although, as earlier noted, this necessitates the user 60 assuming a rather uncomfortable position for prolonged periods of time. Similarly, it will also be appreciated that the hose 46 can be unreeled from the reel C when the cart is in the reeling position illustrated in FIG. 3, although a certain amount of care must be taken to insure that during the unreeling process the cart does not travel along the ground and is not accidentally tipped over.

Figure 6:
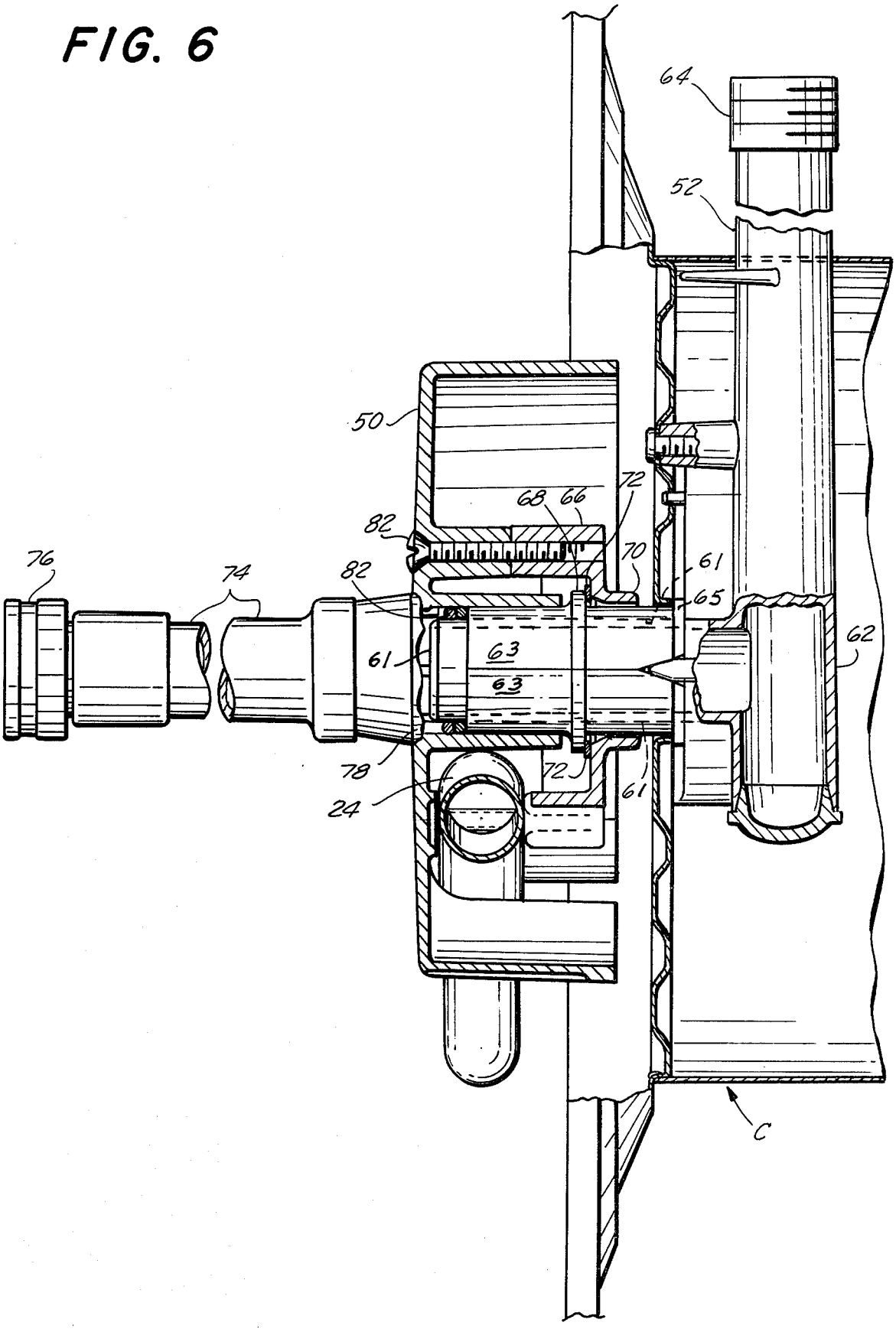
FIG. 6 is a fragmentary side elevation view partially in cross-section and to a greatly expanded scale, of the fluid inlet side of the cart.

Referring now to FIGS. 5 and 6 in particular, therein illustrated is an embodiment of the present invention in which fluid from a fluid source (not shown) may be introduced through a fluid inlet assembly 50 to the interior of the reel C and hence outwardly of the reel C into the hose 46 via a hose connector 52. More particularly, in this aspect of the present invention the reel C has on the inlet side thereof a hollow hub 61 extending axially therefrom along the reel axis. The hollow hub 61 is in fluid connection with the hose connector 52, the latter having one end portion 62 thereof secured to the hub 61 for rotation therewith and the other end 64 thereof exposed on the exterior of reel C (i.e., extending outwardly from the annular surface thereof) and adapted to receive in fluid-tight communication an end of hose 46. A pair of half bearings 63 are disposed about the hub 61, the bearings 63 having an outer flange 65 disposed so as to prevent axial slippage of the bearings 63 relative to the hub 61 away from reel C, and another outer flange 68. An annular hub support 66 is disposed about the bearings 63, thereby to maintain them in position about the reel hub 61. The hub support 66 also precludes the bearings 63 (and hence reel hub 61) from axial retreat in the direction of the crank side of the reel C by virtue of the abutting interaction of the bearing outer flange 68 and the narrow neck 70 of the hub support 66. In order to minimize friction between the bearing outer flange 68 and the hub support neck 70, a ring or greased member 72 is disposed intermediate the otherwise abutting members.

The outer portion of the reel hub 61 is rotatably received within the inlet assembly 50 which is provided with cutouts for passage of the legs 20, 24 of the intermediate portions 14 therethrough. The outer portion of the inlet assembly 50 includes hose means 74 having one end 76 adapted for fluid-tight connection to an external fluid source (not shown) and the other end 78 aligned with and in fluid-tight communication with the reel hub 61. As the inlet assembly 50 is stationary with respect to the frame B while the reel hub 60 is rotatable with respect to the frame B, sealing means 80, such as a pair of rubber O-rings, are provided to insure a fluid-tight communication between the hose means end 78 and the reel hub 61. The inlet assembly 50 is secured to the hub support 66 by means of three screws 82, two of the screws 82 passing through the frame intermediate portion 14 on the way from the inlet assembly 50 to the hub support 66 and the third screw 82 passing directly from the inlet assembly 50 to the hub support 66. When the screws 82 are securing together the inlet assembly 50 and the hub support 66, the sealing means 80 are disposed along the reel axis intermediate portions of the inlet assembly 50 and the bearings 63 and transverse to the reel axis intermediate the reel hub 61 and reel hub support 66.

On the other hand when screws 82 are removed, the inlet assembly 50 is easily separable from the hub support 66, thus enabling the inlet assembly 50 to be separated from the reel hub 61 for replacement of sealing means 80. Inasmuch as sealing means 80 performs a vital function in maintaining fluid-tight communication between the stationary inlet assembly 50 and the rotating reel C and is subject to great wear due to the fact it abuts one rotating and one stationary part, it will be readily appreciated that the ability of the user to effect a replacement of the sealing means 80 by employment of only a screwdriver is a desirable and valuable feature of the present invention. While screws 82 are preferred for the function of securing together the fluid inlet 50 and hub support 66, obviously other securing means well known in the connecting art may also be utilized for this purpose.

Figure 7:
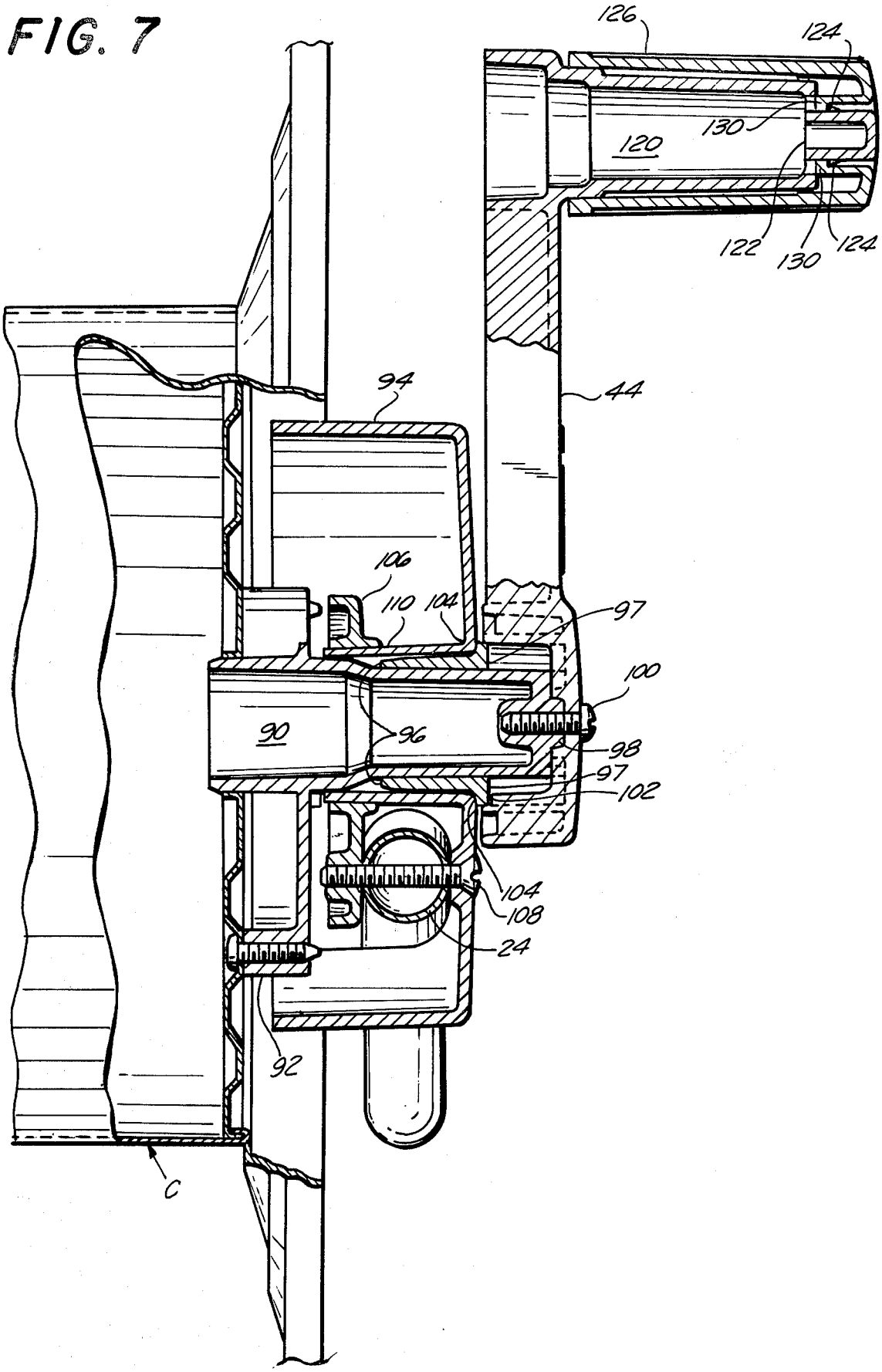
FIG. 7 is a fragmentary side elevation view, partially in cross-section and to a greatly enlarge scale, of the crank side of the cart.

Referring now in particular to FIGS. 5 and 7, therein illustrated is an embodiment of the present invention designed to minimize fatigue of the user during the reeling process. The crank side of the reel C includes an outwardly extending hollow hub 90, the connection of the hub 90 and the reel sidewall being strengthened by employment of a conventional spider structure 92. The hub 90 extends outwardly through a hub assembly 94 disposed thereabout, passes through a crank bearing 96 disposed intermediate an inner surface of the hub assembly 94 and the outer surface of the hub 90, and terminates in an internally threaded end 98. A screw 100 connects one end of the crank means 44 to the internally threaded hub end 98. The bearing 96 has an outwardly flared end 97 captured between a surface 102 of the crank means 44 and a surface 104 of the hub assembly 94. Strengthening member 106 is disposed about the internal end of the hub assembly 94 and connected thereto by means of a pair of screws 108 for the purpose of strengthening the inner wall 110 of the hub assembly 94, so as to insure proper maintenance of the bearing 96 in its desired position. It will be appreciated that the screws 108 not only secure the strengthening member 106 to the hub assembly 94, but also secure both strengthening member 106 and hub assembly 94 to the intermediate portion 14 of the frame B. Like the inlet assembly 50, the hub assembly 94 is provided with cutouts for passage of the legs 20, 24 of the intermediate portion 14 therethrough.

The crank 44 comprises a rigid member extending generally perpendicular to the reel axis, having one end thereof secured to the reel hub end 98 by means of screw 100 and the other end thereof provided with an outwardly extending lug 120. The outward end of the lug 120 terminates in a section 122 of reduced diameter, the section 122 being provided with outwardly extending barbs 124. A hollow handle member 126 with a ridged outer surface (see FIG. 5) to facilitate gripping thereof by the user has an inner surface including a flange portion 130 adapted to be press fit over the barbs 124. The handle 126 is rotatable about the axis of the lug 120, yet precluded from retreat therefrom by the abutting engagement of barbs 124 and inner handle surface flange 130.

To summarize, the hose reel cart of the present invention is capable of assuming three different positions, enables easy replacement of sealing rings by the user, and has a crank means provided with a rotatable handle adapted to conform to the position of the user's wrist during the reeling process. The cart is sturdy and compact, yet simple and inexpensive to manufacture.

Now that the preferred embodiments of the present invention have been shown and described in detail, various improvements and modifications thereon will become readily apparent to those skilled in the art. Accordingly, the spirit and scope of the present invention is to be limited only by the appended claims, and not by the foregoing disclosure.

I claim:

1. A portable hose reel cart comprising:

A. a cart frame comprising a handle portion, a support portion, and a pair of intermediate angled portions, each of said intermediate portions defining in part an opposite side of said frame and connecting said handle portion and said support portion;

B. a reel between said intermediate portions and adapted for rotation about an axis intersecting said intermediate portions, the angle defined by each of said intermediate portions and the lengths of said handle, intermediate and support portions enabling a stable rotatable diposition of said reel above a planar support when said frame is supported on the planar support by said support and handle portions; and C. wheels rotatably secured to said support portions and adapted to form with said support portion a stable base for said frame; whereby said cart is movable to a first stable and generally upright reeling position wherein said frame is supported by said wheels and said support portion, a second stable and generally horizontal unreeling position wherein said frame is supported by both said handle and support portions with said reel being free for rotation, and a third unstable transporting position wherein said frame is supported essentially by only said wheels of said cart.

2. The cart of claim 1 wherein said frame comprises a continuous member.

3. The cart of claim 1 wherein said handle and support portions are both generally U-shaped with each intermediate portion connecting a respective associated end of said handle portion to a respective associated end of said support portion.

4. The cart of claim 1 additionally including crank means operatively connected to said reel for rotating said reel relative to said frame.

5. The cart of claim 1 additionally including a fluid inlet mounted on one of said intermediate portions and adapted for connection to a fluid source, and a hose connector having one end exposed on the exterior of said reel and the other end extending into the interior of said reel and in fluid communication with said fluid inlet.

6. The cart of claim 1 wherein each of said intermediate portions comprises a first leg and a second leg, said legs being angled with respect to each other, said reel axis traversing the vertices of said intermediate portions.

7. The cart of claim 6 wherein each of said first leg portions is secured to said handle portion and each of said second leg portions is secured to said support portion, said leg portions and said handle and support portions being configured and dimensioned to maintain said reel free for rotation above a planar support for said frame when said frame is in said second position and parts of said handle and support portions extending parallel to said reel axis are resting on the support.

8. The cart of claim 1 wherein, when said cart is in said first position, said reel axis is parallel to a second axis vertically displaced therefrom and passing through said support intermediate said wheels and a part of said support portion supporting said frame.

9. The cart of claim 1 wherein said reel has one side thereof defining a hollow hub extending axially therefrom, said cart additionally including an inlet assembly adapted for connection to a fluid source and configured and dimensioned to receive said reel hub therein, replaceable sealing means disposed intermediate portions of said inlet assembly and said reel hub to provide a fluid-tight connection therebetween; and securing means movable between first and second positions, said securing means in said first position securing together said inlet assembly and said hub support with said sealing means disposed intermediate said portions of said inlet assembly and reel hub, and in said second position enabling separation of said inlet assembly and said hub support, whereby said portions of said inlet assembly and reel hub are separable to enable replacement of said sealing means.

10. The cart of claim 1 additionally including crank means secured to said reel for rotating said reel relative to said frame, said crank means including a lug extending along an axis generally parallel to the axis of said reel, and handle means disposed about said lug, said handle means being rotatable about said lug axis and precluded from axial retreat from said lug.

* * * * *